United States Patent [19]

Nabulon

[11] Patent Number: 4,999,890

[45] Date of Patent: Mar. 19, 1991

[54] METHOD OF OPERATING A TEXTURING NOZZLE

[75] Inventor: Werner Nabulon, Rudlingen, Switzerland

[73] Assignee: Rieter Machine Works, Ltd., Winterthur, Switzerland

[21] Appl. No.: 388,161

[22] Filed: Aug. 1, 1989

[30] Foreign Application Priority Data

Aug. 29, 1988 [CH] Switzerland ..... 03204/88

[51] Int. Cl.[5] ..... D02G 1/16

[52] U.S. Cl. ..... 28/271; 28/249

[58] Field of Search ..... 28/247, 248, 249, 254, 28/255, 267, 271

[56] References Cited

U.S. PATENT DOCUMENTS 3,921,419 11/1975 Rosenkranz et al. ..... 68/5 D
4,036,924 7/1977 Shishoo et al. ..... 28/100 X
4,104,085 3/1977 Fink et al. ..... 28/248
4,338,776 7/1982 Krenzer ..... 28/271 X
4,465,490 8/1984 von der Eltz ..... 8/149.1 X

FOREIGN PATENT DOCUMENTS 0021573 1/1981 European Pat. Off. .

*Primary Examiner*—Werner H. Schroeder
*Assistant Examiner*—Bradley Kurtz DeSandro
*Attorney, Agent, or Firm*—Kenyon & Kenyon

[57] ABSTRACT

The texturing nozzle is supplied with a heating medium such as hot air during a start-up phase for preheating of the nozzle and the associated parts of the texturing machine. After a predetermined temperature has been reached, superheated steam is delivered via changeover valve and a heater to the nozzle to carry out a texturing operation therein. The changeover valve may be operated to switch over to hot air during a running-down phase of the machine.

13 Claims, 2 Drawing Sheets

METHOD OF OPERATING A TEXTURING NOZZLE

Figure 1:
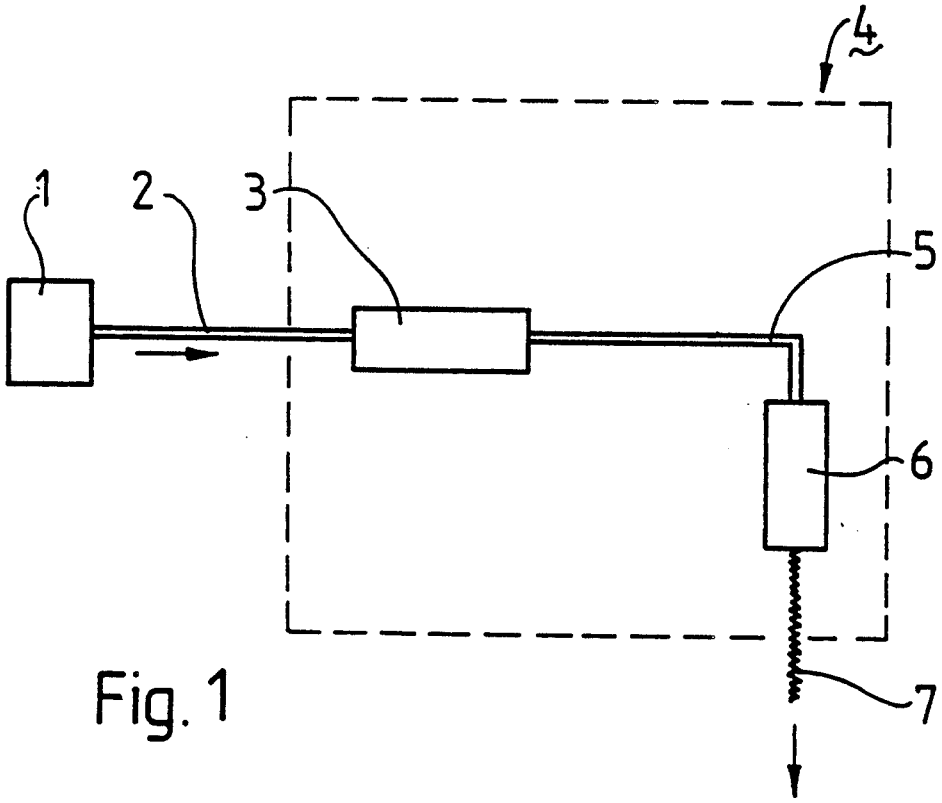

This invention relates to a method of operating a texturing nozzle of a textile machine. More particularly, this invention relates to a method of heating a texturing nozzle of a textile machine.

As is known, in machines for producing "crimped" yarns, it is a universal practice to longitudinally compress or bulk a filament or multifilament which is subsequently wound in order to increase the volume of the filament, thus giving the filament special properties, such as better covering power in carpets. Usually, the filament is stuffed or bulked in a texturing nozzle in which the yarn is conveyed by hot air under pressure. If the pressure is suddenly released, a plug forms in the stuffing part of the texturing nozzle. The filaments strike the plug, resulting in the texturing effect.

In some known methods of producing textured filaments, a specially designed texturing nozzle is supplied with superheated steam. However, upon flowing through the machine, of course, the steam naturally tends to condense, so that special means are necessary for discharging the resulting liquid. Although it has been known to reduce condensation by electrically heating the steam ducts throughout the machine, this results in relatively complex constructions and also uses energy.

U.S. Pat. No. 4,104,085 describes a method for texturizing thermoplastic yarn wherein a heated dry gas is employed to convey a yarn into a bulking apparatus to form a compact mass of yarn. The process is characterized in that an auxiliary gas is introduced into the bulking apparatus at a lowered temperature to convey the yarn during start-up and/or shut down of the apparatus to avoid overheating and fusion of the yarn and to thereby prevent plugging of the apparatus.

European Patent Application No. 0021573 describes a method of texturizing thermoplastic yarn wherein a yarn plug is formed within a texturizing nozzle and the yarn temperature controlled by means of an auxiliary heating element in the path of the gas or steam passed into the nozzle.

Accordingly, it is an object of the invention to greatly reduce condensation in texturing machines operating on superheated steam.

It is another object of the invention to avoid a need for a means for discharging liquid from textile machines employing steam for conducting an operation therein.

It is another object of the invention to eliminate condensation in a texturing nozzle supplied with steam during operation.

Briefly, the invention provides a method of operating a textile machine, particularly a texturing nozzle in the machine, which includes the steps of supplying a heating medium of low-moisture content to the machine for pre-heating the machine to a predetermined operating temperature and thereafter supplying a medium of high moisture content to the pre-heated textile machine for conducting an operation therein without appreciable condensation occurring therein.

In the case of a texturing nozzle, the heating medium is supplied during a start-up phase as well as a running down phase while the moisture-containing medium is supplied to the nozzle during a yarn texturing phase.

The invention also provides a textile machine having a texturing nozzle with a heating medium source for supplying a heating medium to the nozzle, a moisture-containing medium source for supplying a moisture-containing medium to the nozzle and a change-over valve connected between the two sources and the nozzle for selectively connecting one of the sources to the nozzle in order to supply a respective medium thereto.

As a result of the construction, the passageways between the texturing nozzle and the moisture-containing medium source are preheated so that no appreciable condensation occurs and no means are required for discharging condensed liquid.

The heating medium for pre-heating the texturing nozzle may be hot air while the moisture containing medium is a gas having a high moisture content or superheated steam.

The amount of condensation depends mainly on the degree of saturation of the moist air, the temperature of the medium, the air temperature and the temperature of the connection coming into contact with the moisture-containing gas air or steam. If therefore the length of the heating-up time is suitably chosen, practically no condensation occurs.

The aforementioned method and apparatus has been described in conjunction with a texturing nozzle, but this in no way restricts the use of the method. The process may also be applied in the same or similar manner to yarn-bulking machines or "heat-set" installations. Other possible applications are in calendar heating and finishing machines generally. In accordance with the preceding remarks, two gases having different moisture contents are supplied in time-multiplex manner, so that a change-over valve is advantageously provided.

During operation, the heating medium and the gas having the high moisture content are fed to the change-over valve which is constructed so that the fed media are separated in accordance with a preset time schedule. Optionally, the media are changed over at the same time, but it may also be advantageous if, when the valve is changed over, the supply of dry medium is initially interrupted, and both connections to the texturing nozzle are briefly blocked before the medium required for texturing flows to the nozzle. Electrical or mechanical means are equally useful for this purpose. The machine can also run down in accordance with a given schedule. It is particularly economic to use air having a low moisture content as the heating medium. However, there is no difficulty in using other media.

The valve can be changed over in various ways. Electric, pneumatic and hydraulic change-over facilities may all be used. The time of changing over the valve can be preset in a very simple manner, using an electric control element. Advantageously however, the change-over valve is controllable by a switching element which signals the operating state of the texturing nozzle, or is alternatively controllable by a temperature sensor which signals when the texturing nozzle is ready for operation, so that the nozzle temperature is a direct criterion for changing over the valve. This applies at least to the start-up phase. The nozzle temperature can be determined in a very simple manner via a resistance thermometer, or alternatively a number of resistance thermometers can be connected to the nozzle and received by a closed or open loop control circuit for obtaining a characteristic overall signal. Alternatively, use may be made of a bimetal, which actuates the change-over valve either mechanically or electrically.

In these devices, a heater may be disposed between the change-over valve and the texturing nozzle with the output temperature of the heater and the temperature at the texturing nozzle preferably being between 150° and 400° C. When this feature is used, air is fed to the machine e.g. at room temperature and at a pressure of about 10 bar. Alternatively, the media fed to the change-over valve can both be at a temperature of about 100° C., in which case, the media are heated in a central preheater. In all cases, the final texturing temperature is obtained in the heater. To save energy, the heater is disposed as near as possible to the texturing nozzle, to minimize heat losses in transit from the heater to the nozzle. The output temperature or heating capacity of the heater can be switched on or adjusted depending on the application and medium. In the simplest case, the heater is powered by electricity. The preheater may also be powered by electricity, taking care that the second heater is regulated by a closed-loop control circuit, so that the output temperature of the heater is very constant.

The change-over valve can be actuated directly or indirectly via a linkage, a bimetal and/or a solenoid valve. For direct mechanical actuation of the change-over valve, the valve and the contacts must be placed in the immediate neighborhood of the texturing nozzle, to avoid any appreciable mechanical losses during actuation.

An acoustic contact or temperature sensor may also be disposed on the texturing nozzle and connected by a control circuit to the change-over valve in order to control the valve change-over, automatically or otherwise. This also opens the possibility of keeping the second medium switched off for a preset time, so that the ducts inside the machine can be sufficiently dried to reduce condensation to a minimum.

Figure 2:
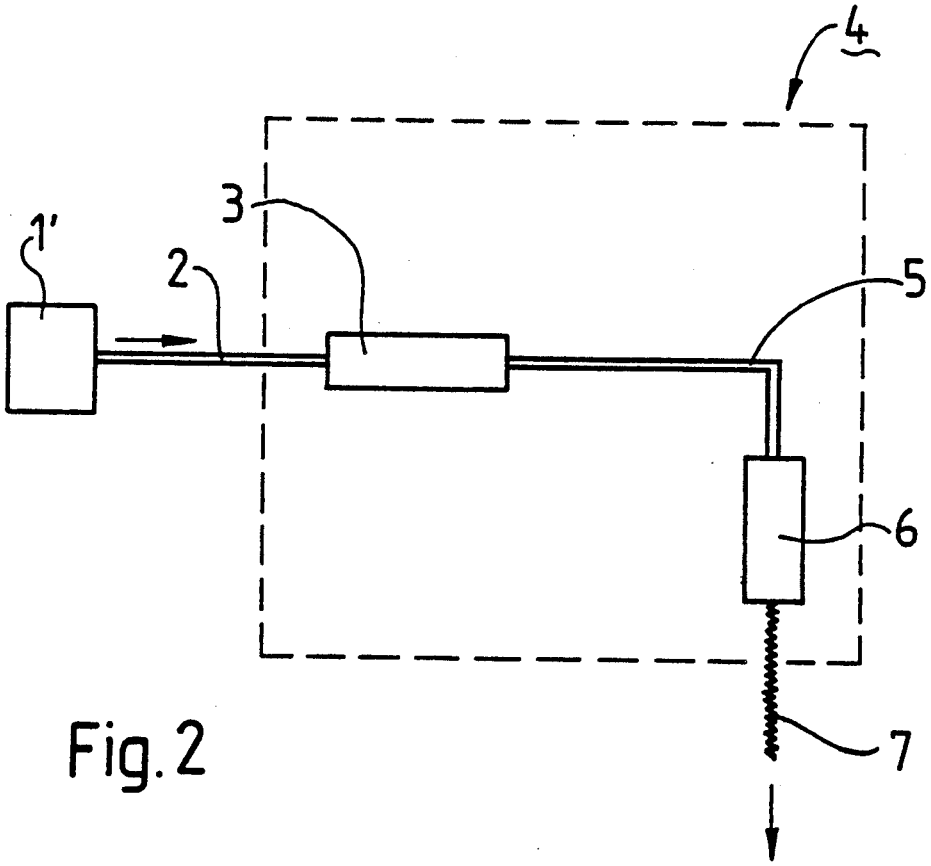
Figure 3:
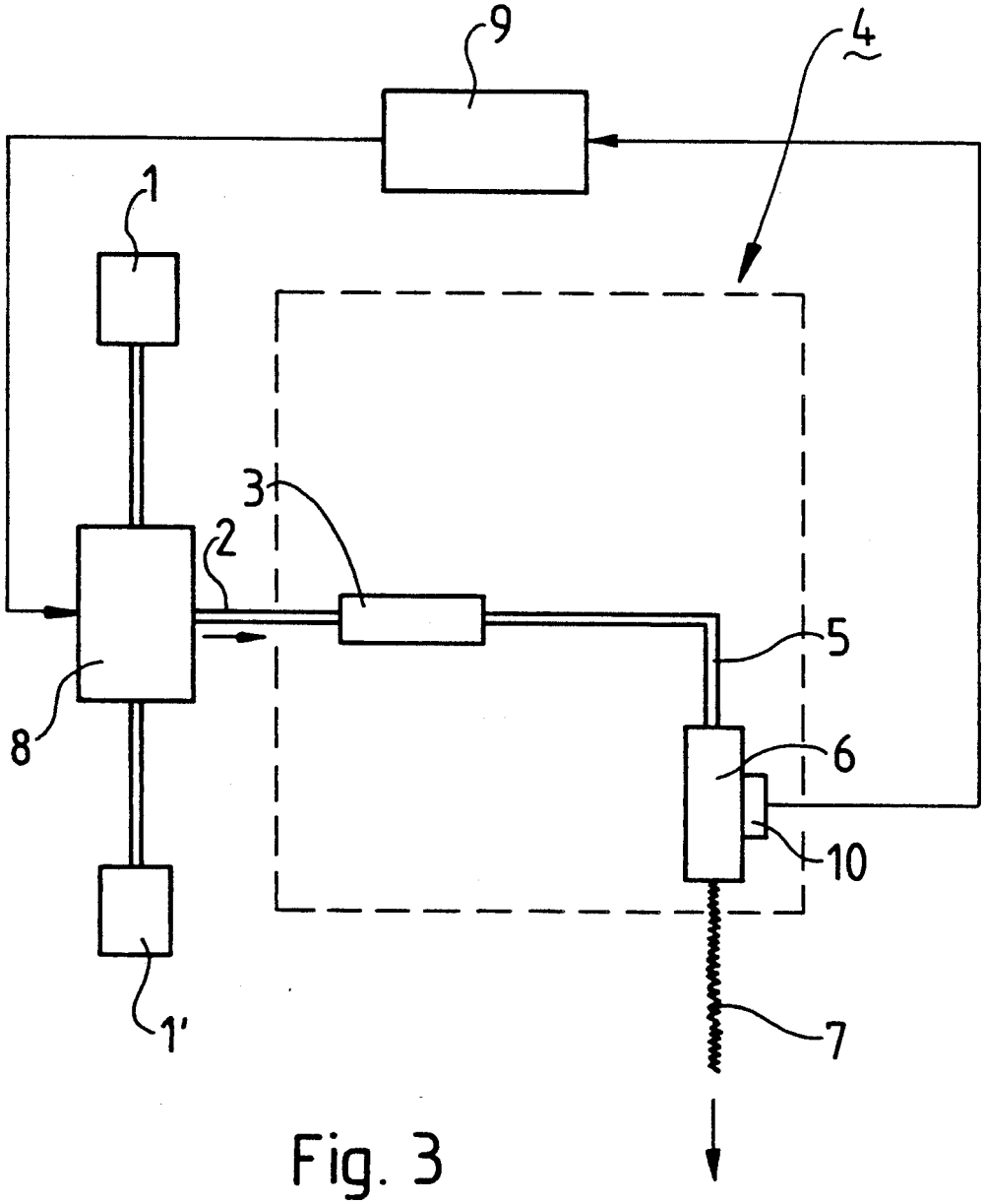

These and other objects and advantages of the invention will become more apparent from the following detailed description taken in conjunction with the accompanying drawings wherein:

FIG. 1 diagrammatically illustrates a texturing machine having a texturing nozzle operating exclusively on hot air;

FIG. 2 diagrammatically illustrates a texturing machine operated exclusively on superheated steam; and FIG. 3 illustrates a texturing machine constructed in accordance with the invention employing hot air and superheated steam.

Like reference characters indicate like parts in FIGS. 1 to 3.

Referring to FIG. 1 in a known texturing machine, compressed air at a temperature of e.g. 10° C. and a pressure of e.g. 10 bar is supplied from a compressed-air source 1 to a texturing machine 4. The compressed air travels through a pipe 2 to a heater 3 and is heated to a suitable temperature. The heated air is supplied through an additional pipe 5 to a texturing nozzle 6, in which a textured yarn 7 is produced. Devices of this kind are known and do not cause any problems of condensation.

Referring to FIG. 2, the texturing machine 4 has also been known to use a steam source 1' supplying saturated steam at a temperature of e.g. 180° C., instead of hot air in certain texturing processes. In other respects the process is the same as described in FIG. 1.

As is known, installations as in FIG. 2 have the disadvantage that saturated steam delivered by the heater 3 condenses in transit from the superheater to the texturing nozzle 6 during the heating-up or cooling-down phase, so that additional means have to be provided for removing the resulting liquid from the texturing machine 4. During at least the starting and the running-down phase of machine 4, liquid is produced in quantities which, if not efficiently removed, may seriously foul the machine 4.

Referring to FIG. 3, in accordance with the invention, the texturing machine 4 is provided with a heating medium source 1 for supplying a heating medium such as hot air and a moisture-containing medium source for supplying a moisture-containing medium such as steam as well as a change-over valve connected between the two sources 1, 1' for selectively connecting one of the sources to a nozzle 6 to supply a respective medium thereto. As indicated, the change-over valve supplies the respective medium through a pipe 2 to a heater 3 for heating therein. The heater 3 is, in turn, connected by a pipe 5 to the texturing nozzle 6 from which a textured yarn 7 is produced in an additional heater.

The outlet temperature of the media exiting from the respective source 1, 1' have a temperature of for example 180° C. The hot air can preferably be at a somewhat higher temperature, for example from 10° to 20° C. higher than the steam in order to avoid condensation in the valve 8.

As indicated in FIG. 3, a temperature sensor 10 or a contact for the position of the texturing nozzle 6 is brought into contact with the nozzle 6 in order to sense the temperature thereat. The sensor 10 serves to deliver an output signal to a control circuit 9 which generates control signals for changing over the valve 8. The control circuit 9 is connected to the valve 8 so as to actuate the valve in dependence on the temperature of the nozzle.

The aforementioned machine operates in accordance with a method described hereinafter in detail. When machine 4 is started up, a control contact (not shown) detects that the texturing nozzle 6 is being heated up or alternatively the temperature sensor 10 detects that the texturing nozzle 6 is cold and sends a corresponding signal to the control circuit 9.

The control signal is amplified as required in the control circuit 9 and reaches the control input of the change-over valve 8 which, under these operating conditions, connects the hot-air source 1 to the pipe 2. The hot air is additionally heated in heater 3 and flows through the entire pipe system of machine 4, thus heating the machine 4 to a temperature of e.g. 250° C. After a yarn has been drawn into the texturing nozzle 6, the control contact recognizes the "texturing" position or, alternatively, the state of heating of the machine 4 or the texturing nozzle 6 is recognized by the temperature sensor 10. As a result, the control circuit 9 generates an output signal which switches over the valve 8, so that saturated superheated steam from source 1' enters the line 2 and is processed in the manner described in connection with FIG. 2.

When the superheated steam enters the pipe system of the machine 4 which has been preheated by hot air, the amount of condensed fluid is nil or vanishingly small, and does not need any special discharge means.

The control circuit 9 in FIG. 3 can be constructed so that after the texturing process stops, the supply of hot air from the source 1 is maintained for a preset time to ensure that the piping system in the machine and the units disposed in the piping system are dried to avoid soiling the machine 4.

The invention thus provides a relatively simple method of heating a textile machine so as to avoid condensation caused by the use of superheated steam therein.

Further, the invention provides a superheated system for heating a texturing nozzle which eliminates a need for special means for discharging liquid condensate therefrom.

What is claimed is:

1. A method of operating a texturing nozzle of a textile machine comprising the steps of supplying a heating medium to the nozzle during a start-up phase;

thereafter supplying a moisture-containing medium to the nozzle during a yarn texturing phase; and then supplying the heating medium to the nozzle during a running-down phase.

2. A method as set forth in claim 1 wherein said heating medium is hot air and said moisture-containing medium is steam.

3. A method as set forth in claim 2 wherein said hot air is at a higher temperature than said steam.

4. A method as set forth in claim 2 wherein the heating medium and steam are at temperature in the range of from 150° to 400° C.

5. A method of operating a textile machine comprising the steps of supplying a heating medium of low-moisture content to the textile machine for pre-heating the machine to a predetermined operating temperature; and thereafter supplying a medium of high-moisture content to the pre-heated textile machine for conducting an operation therein without appreciable condensation occurring therein.

6. A method as set forth in claim 5 wherein said heating medium is hot air and said moisture-containing medium is steam.

7. A method as set forth in claim 6 wherein said hot air is at a higher temperature than said steam.

8. A method as set forth in claim 5 wherein the heating medium and moisture-containing medium are at temperature in the range of from 150° to 400° C.

9. In a textile machine, the combination comprising a texturing nozzle;

a heating medium source for supplying a heating medium to said nozzle during a start-up phase;

a moisture-containing medium source for supplying a moisture-containing medium to said nozzle during a yarn texturing phase; and a change-over valve connected between said sources and said nozzle for selectively connecting one of said sources to said nozzle to supply a respective medium thereto.

10. The combination as set forth in claim 9 which further comprises a temperature sensor connected to said nozzle for sensing the temperature thereof and a control circuit connected to and between said temperature sensor and said valve to actuate said valve in dependence on the temperature of said nozzle.

11. The combination as set forth in claim 10 wherein said control circuit maintains the supply of the heating medium to said nozzle after de-activation of said control circuit.

12. The combination as set forth in claim 9 which further comprises a heater connected to and between said valve and said nozzle for heating the medium passing from said valve to said nozzle.

13. The combination as set forth in claim 12 wherein said heater is an electric heater.

* * * * *